US011268774B1

(12) United States Patent
Landies, III et al.

(10) Patent No.: US 11,268,774 B1
(45) Date of Patent: Mar. 8, 2022

(54) FIREARM TOP COVER WITH MULTIPLE DEGREES OF FREEDOM OF MOTION

(71) Applicant: Ohio Ordnance Works, Inc., Chardon, OH (US)

(72) Inventors: Robert W. Landies, III, Chardon, OH (US); Thomas M. Hardman, Chesterland, OH (US); Brent Susnik, Twinsburg, OH (US)

(73) Assignee: Ohio Ordnance Works, Inc., Chardon, OH (US)

( * ) Notice: Subject to any disclaimer, the term of this patent is extended or adjusted under 35 U.S.C. 154(b) by 0 days.

(21) Appl. No.: 17/164,298

(22) Filed: Feb. 1, 2021

(51) Int. Cl.
*F41A 9/29* (2006.01)
*F41A 3/66* (2006.01)

(52) U.S. Cl.
CPC ..... *F41A 3/66* (2013.01); *F41A 9/29* (2013.01)

(58) Field of Classification Search
CPC ..... F41A 9/34
USPC ..... 89/33.14, 33.2, 33.25
See application file for complete search history.

(56) References Cited

U.S. PATENT DOCUMENTS 3,425,317 A * 2/1969 Menneking ..... F41A 9/54 89/33.2
3,680,432 A * 8/1972 Rocha ..... F41A 9/37 89/33.04
3,688,641 A * 9/1972 Curtis ..... F41A 19/34 89/189
10,746,493 B1 * 8/2020 Steimke ..... F41A 5/18
11,156,415 B2 * 10/2021 Franssen ..... F42B 39/08
2013/0047828 A1 * 2/2013 Smith ..... F41A 9/01 89/33.14
2015/0267984 A1 * 9/2015 Kokinis ..... F41A 5/26 42/14
2018/0058816 A1 * 3/2018 Geissele ..... F41G 11/003
2019/0339032 A1 * 11/2019 Barrett ..... F41A 3/66

FOREIGN PATENT DOCUMENTS

GB 2254912 A * 10/1992 ..... F41A 17/00

* cited by examiner

*Primary Examiner* — Reginald S Tillman, Jr.
(74) *Attorney, Agent, or Firm* — Renner Kenner Greive Bobak Taylor & Weber

(57) ABSTRACT

A belt-fed firearm includes a top cover that can move in at least two degrees of freedom of motion (surge, sway, heave, roll, pitch, and yaw) that in combination allow movement of the top cover to both clear a peripheral accessory mounted to the firearm (such as optics) and open access to a feed surface to permit loading of cartridges to the feed surface.

20 Claims, 15 Drawing Sheets

FIREARM TOP COVER WITH MULTIPLE DEGREES OF FREEDOM OF MOTION

FIELD OF THE INVENTION

The present invention generally relates to top covers for belt-fed firearms. In some embodiments, the present invention relates to top covers that can be moved in at least two degrees of freedom of movement. In some embodiments, the invention is directed to top covers that move so as to avoid optics or other peripheral accessories mounted in a manner that extends over the top cover so as to prevent a pivotal (pitch movement) opening of the top cover upwardly.

BACKGROUND OF THE INVENTION

Currently, the vast majority of top covers for belt-fed firearms, often interacting with a feed tray to hold cartridges, either pivot upwardly in a pitch movement or translate linearly in a sway movement to allow for the loading or unloading of cartridges. The pitch movement is especially troublesome as the top cover might be prevented from opening when optics or some other peripheral accessory extends over the top of the top cover. Thus, the present invention improves on the art of top covers by structure that allows the top cover to be opened for loading of cartridges even in instances where a peripheral accessory extends over the top of the cover. This invention is applicable to both those firearms with feed trays and to those simply providing a feed surface, for example, a feed surface of a trunnion.

SUMMARY OF THE INVENTION

An embodiment of the present invention provides a firearm having a top cover manipulatable to provide access to a feed surface for cartridges, the improvement comprising the top cover moving in at least two degrees of freedom.

Another embodiment provides a firearm as in any embodiment above, wherein the at least two degrees of freedom together allow movement of the top cover to both clear a peripheral accessory mounted to the firearm and open access to the feed surface to permit loading of cartridges to the feed surface.

Another embodiment provides a firearm as in any embodiment above, wherein the at least two degrees of freedom are selected from surge, sway, heave, roll, pitch, and yaw.

Another embodiment provides a firearm as in any embodiment above, wherein a first degree of freedom of the at least two degrees of freedom permits movement of the top cover in such a way as to separate the top cover from the feed surface (in some embodiments, disengaging the top cover from the feed surface).

Another embodiment provides a firearm as in any embodiment above, wherein a second degree of freedom of the at least two degrees of freedom permits movement of the top cover to a side of the firearm, so that the top cover is configured to move out from under a peripheral accessory, if any, on the firearm.

Another embodiment provides a firearm as in any embodiment above, wherein the first degree of freedom is a heave movement along a z-axis in the direction of from the underside of the firearm to the topside of the firearm.

Another embodiment provides a firearm as in any embodiment above, wherein the second degree of freedom is a yaw movement relative to an x-axis in the direction of from the back of the firearm to the front of the firearm and rotating about the z-axis.

Another embodiment provides a as in any embodiment above, wherein the yaw movement opens access to the feed surface to permit loading of cartridges to the feed tray.

Another embodiment provides a firearm as in any embodiment above, further comprising a post extending along the z-axis, the top cover pivotally secured to the post for said yaw movement and movable along said post for said heave movement.

Another embodiment provides a firearm as in any embodiment above, wherein a first degree of freedom is a sway movement relative to a y-axis in the direction of from the right side of the firearm to the left side of the firearm.

Another embodiment provides a firearm as in any embodiment above, wherein a second degree of freedom of the at least two degrees of freedom opens access to the feed surface to permit loading of cartridges to the feed surface.

Another embodiment provides a firearm as in any embodiment above, wherein the second degree of freedom is a pitch movement relative to the y-axis.

Another embodiment provides a firearm as in any embodiment above, further comprising a rail extending along the y-axis, the top cover pivotally secured to the post for said pitch movement and movable along said rail for said sway movement.

Another embodiment provides a firearm as in any embodiment above, wherein the feed surface is provided by a feed tray, and the feed tray moves with the top cover through said sway movement along the rail in the first degree of freedom, and thereafter the top cover moves through said pitch movement to provide access to the feed tray.

Another embodiment provides a firearm as in any embodiment above, wherein the top cover and the feed tray engage in a closed position and are released from engagement to allow for said pitch movement of the top cover.

Another embodiment provides a firearm as in any embodiment above, wherein cartridges can be properly loaded to the feed tray after said sway movement and pitch movement of the top cover.

Another embodiment provides a firearm as in any embodiment above, wherein the feed tray is also movable through said pitch movement to provide access to internal components or areas of the firearm.

Another embodiment provides a firearm comprising a top cover wherein the top cover can move in at least two degrees of freedom of motion selected from surge, sway, heave, roll, pitch, and yaw, and wherein the movement in at least two degrees of freedom allows movement of a top cover to clear a peripheral accessory mounted to the firearm and allows open access to a feed surface of the firearm to permit loading of cartridges to the feed surface.

Another embodiment provides a firearm as in any embodiment above, wherein a first degree of freedom of the at least two degrees of freedom disengages the top cover from the feed surface.

Another embodiment provides a firearm as in any embodiment above, wherein a second degree of freedom of the at least two degrees of freedom permits movement of the top cover to a side of the firearm, so that the top cover is configured to move out from under a peripheral accessory, if any, on the firearm.

DETAILED DESCRIPTION OF ILLUSTRATIVE EMBODIMENTS

The present invention is disclosed using images of a specific belt-fed firearm f, but those of ordinary skill in the art will readily appreciate the application of this invention to any number of firearms though differently structured as to their top cover and the portion of the firearm that provides a feed surface that serves to receive cartridges (be it a feed surface provided by a trunnion or a feed tray or other structure). Feed trays are specifically shown to provide the feed surface, but the present invention is not limited to or by their use/presence. Specific structures are shown here by way of example only to teach the full breadth of the concept to those of skill in the art, and nothing shall be construed as serving to limit the breadth of this invention simply for being specifically disclosed. Two specific embodiments are disclosed, without limitation, and the claims will define the invention.

Figure 8:
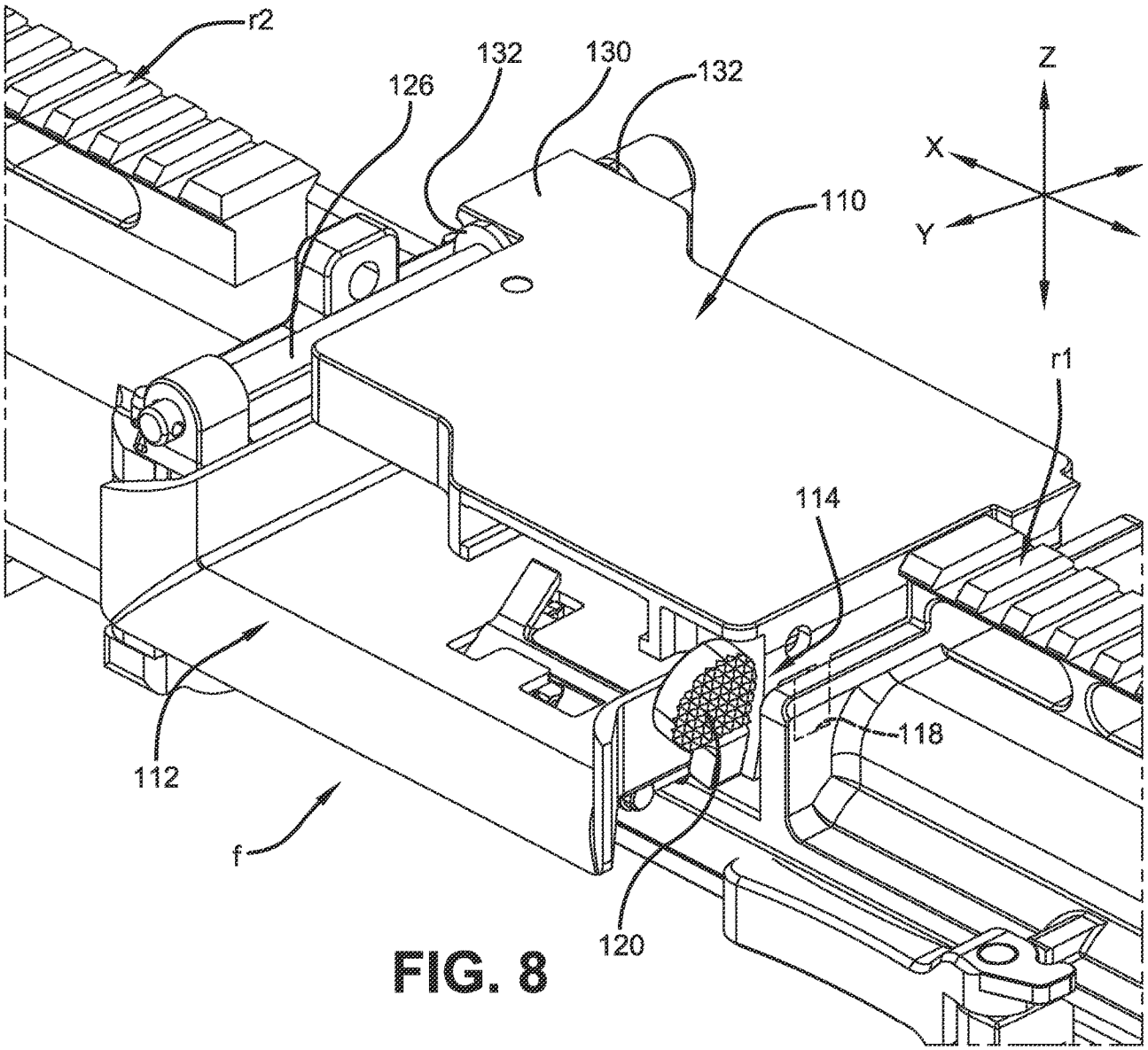
FIG. 8 is a perspective view showing relevant portions of a firearm and a top cover in accordance with a second embodiment of this invention.
Figure 12:
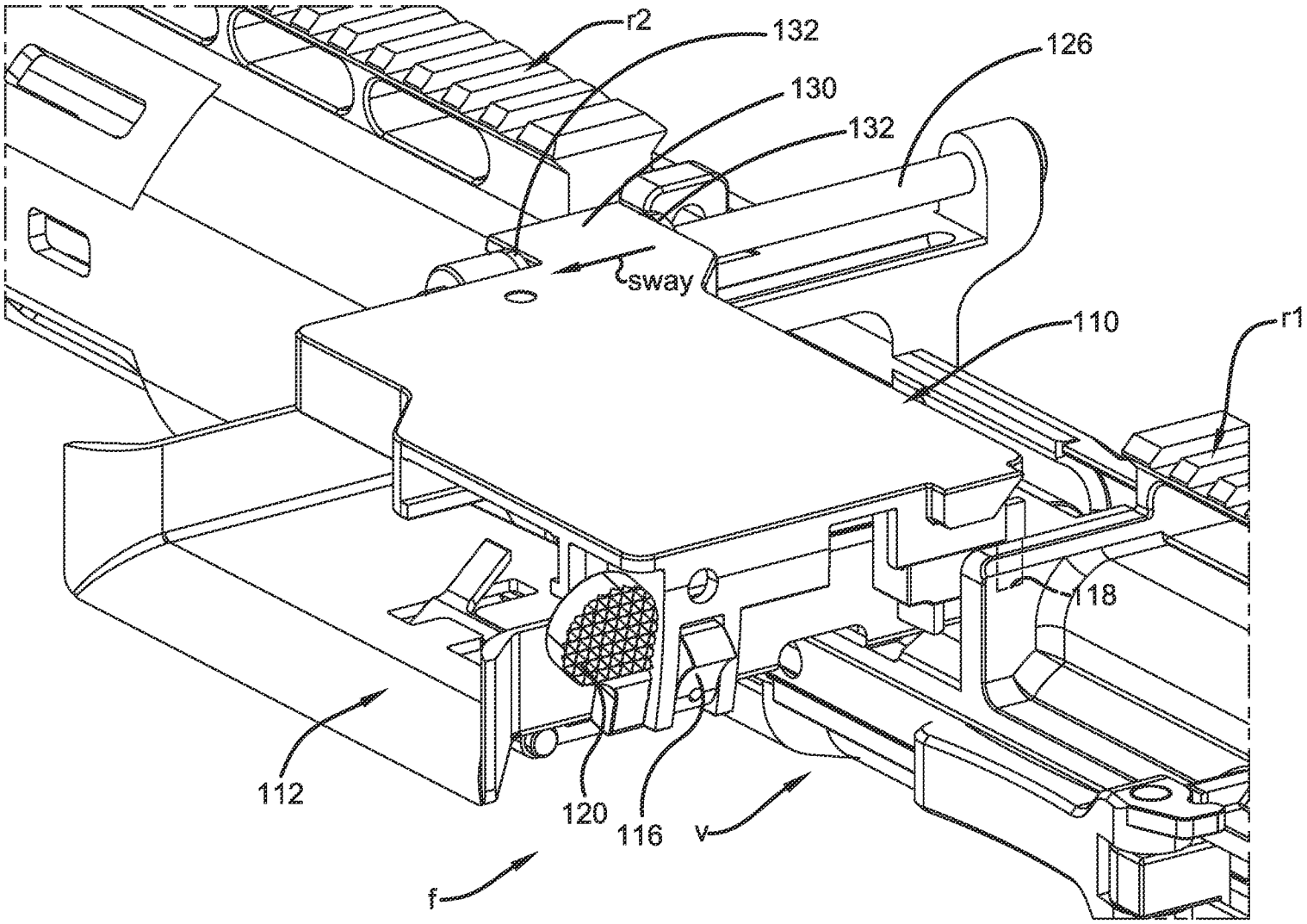
FIG. 12 is a perspective view of the embodiment of FIG. 8, showing the top cover moved linearly out to the side of the firearm in a sway movement, the feed tray moving with the top cover.
Figure 13:
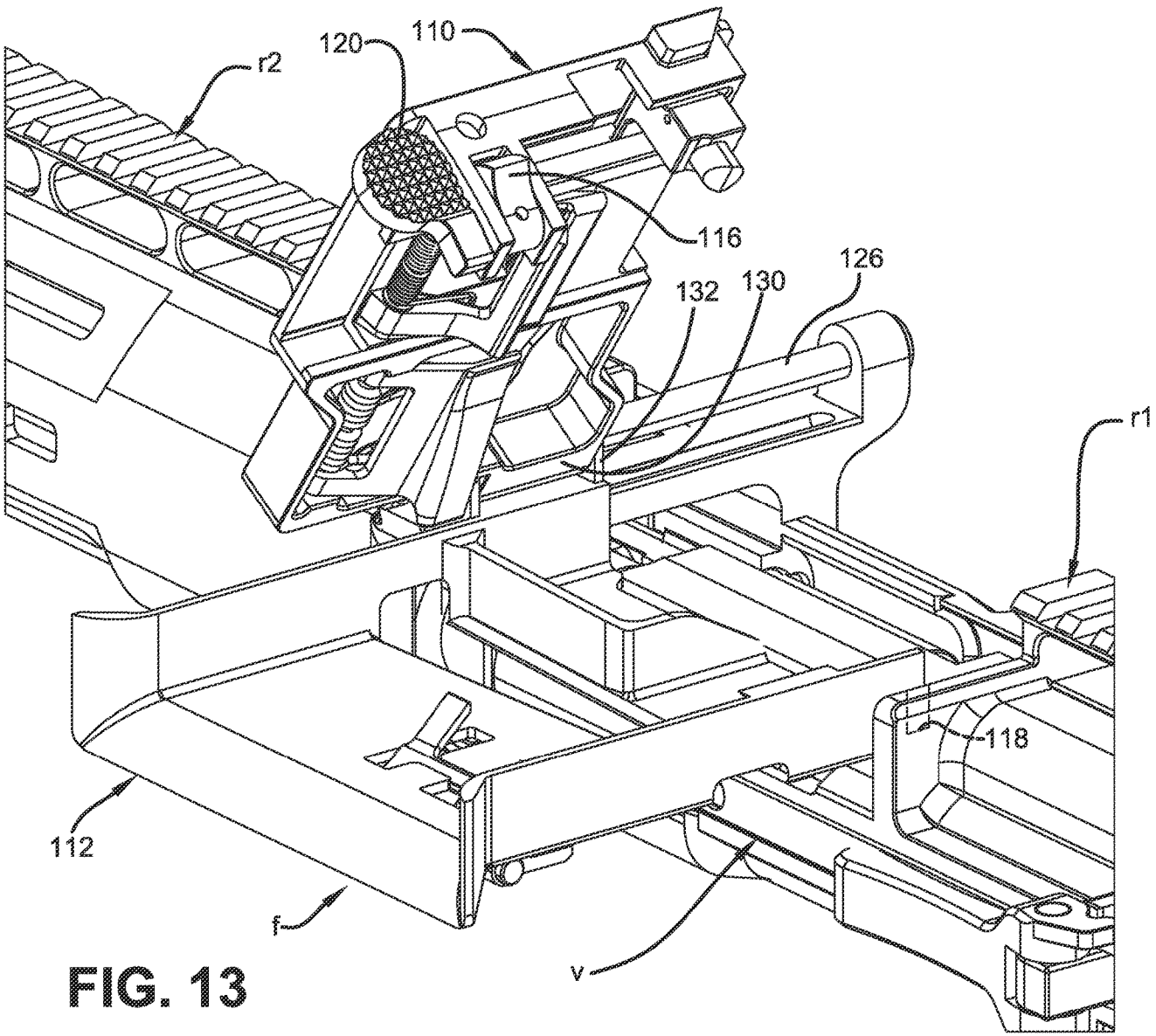
FIG. 13 is a perspective view of the top cover as in FIG. 12, showing the top cover pivoted upwardly in a pitch movement to provide access to a feed tray for loading cartridges.

Referring now to the embodiment shown in FIGS. 1-4 and the embodiment shown in FIGS. 8, 12, and 13, it can be most basically appreciated that the present invention provides a firearm having a top cover that can be manipulated to provide access to a feed surface for cartridges, the improvement being that the top cover is able to move in at least two degrees of freedom. In FIGS. 1-4, the top cover can be seen to translate in a linear heave movement and rotate in a yaw movement, the heave movement opening the top cover up off of the feed surface provided by the feed tray, and the yaw movement providing access to the feed surface of the feed tray and also positioning the majority of the top cover off to the side of the firearm. In FIGS. 8, 12, and 13, the top cover can be seen to move in a linear sway movement and a rotational pitch movement, the sway movement moving the top cover off to the side of the firearm, and the pitch movement opening the top cover off the feed tray and permitting access to the feed surface. It will be appreciated that either of these embodiments allows the top cover to be moved off of the feed surface to provide access thereto, even if optics or some other peripheral accessory is mounted to the rail of the firearm generally over the top cover in the firing position.

The present invention, in its broadest sense, provides a top cover that can move in 2 or more of the accepted six degrees of freedom. The limited number of embodiments here show specific movements, but it will be appreciated that the present concept, once taught herein, can be adapted to any number of structures providing top covers moving otherwise than specifically shown in these embodiments, but still moving in 2 or more of the six degrees of freedom in accordance with this invention.

Figure 1:
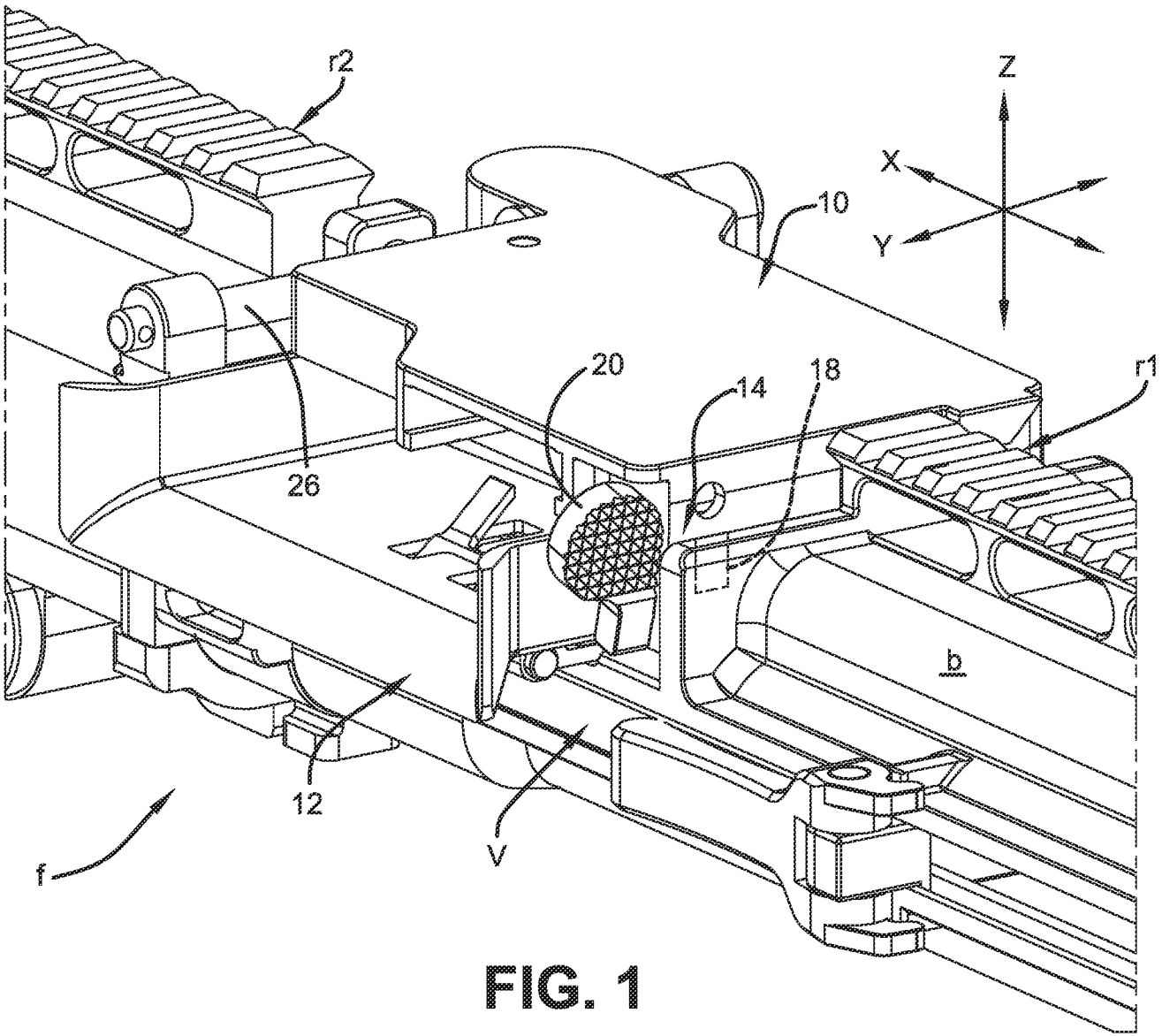
FIG. 1 is a perspective view showing relevant portions of a firearm and a top cover in accordance with an embodiment of this invention.

In FIGS. 1 and 8, coordinate axes are provided relative to the length of the firearm f to help disclose movements or what are also referred to and generally known as degrees of freedom. For orientation, the x-axis is defined to be in the direction of from the back of the firearm to the front of the firearm f (which in the embodiment shown is also in the direction of the rails r1, r2); the y-axis is defined in the direction of from the right side of the firearm to the left side of the firearm; and the z-axis is defined in the direction of from the underside of the firearm to the topside of the firearm. A heave movement is moving up and/or down on the z-axis; a yaw movement is rotating left and/or right on the z-axis; a sway movement is translating left and/or right on the y-axis; and a pitch movement is tilting forward and backward on the y-axis. These will help in the understanding of each embodiment.

Referring now to FIG. 1-7, the firearm f includes a receiver v having a top cover 10 that moves in two degrees of freedom, with a heave movement (from FIG. 1 to FIG. 2) opening the top cover 10 up off of the feed tray 12 providing a feed surface 15, and a yaw movement rotating the top cover 10 out from overtop of the feed tray 12 to permit loading or unloading. The top cover 10 has a firing position (e.g., FIG. 1), where cartridges c loaded and held between the top cover 10 and feed tray 12 can be fired as commonly known. In some embodiments, the top cover has a latching mechanism 14 serving to hold the top cover 10 in the firing position and being manipulatable to release the top cover 10 from the firing position and permit the movements described. In some embodiments, the latching mechanism 14 includes a latch 16 associated with the top cover 10 and a catch 18 associated with the remainder of the firearm f so as to interact and releasably hold the top cover 10 in the firing position (closed on the feed tray 12). In other embodiments, the latch is associated with the firearm and the catch is part of the top cover, as the interaction of latches and catches is relative and reversible. In some embodiments, a push button 20 is associated with the latch 16 to move the latch out of contact with catch 18 and permit the heave movement. In some embodiments, the push button 20 works against a spring load against the latch 16, the spring load urging the latch 16 to the position at which it interacts with and latches to the catch 18. In the particular embodiment shown, the catch 18 is provided in the firearm's upper receiver and holds the top cover to prevent the upward heave movement next disclosed. Although a single latch is shown, in this or other embodiments, there could be multiple latching mechanisms to prevent different movements or secure different parts together. Push buttons are just one mechanism found useful in the exemplary embodiments, and those of ordinary skill in the art will readily appreciate that other mechanisms could be used to catch and release parts.

Figure 2:
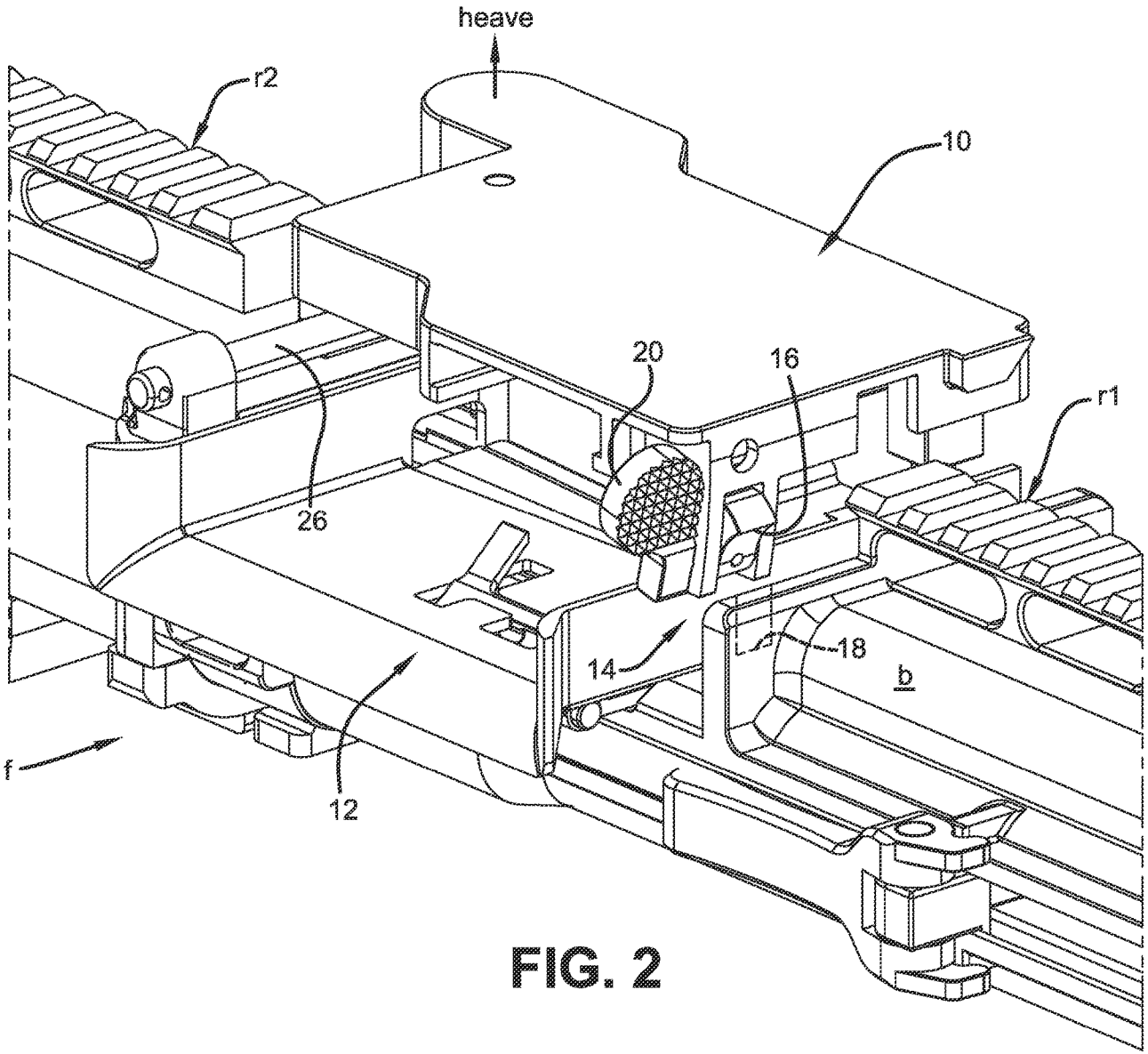
FIG. 2 is a perspective view of the embodiment of FIG. 1, showing the top cover moved upwardly in a heave movement to then allow further movement in a second direction.
Figure 3:
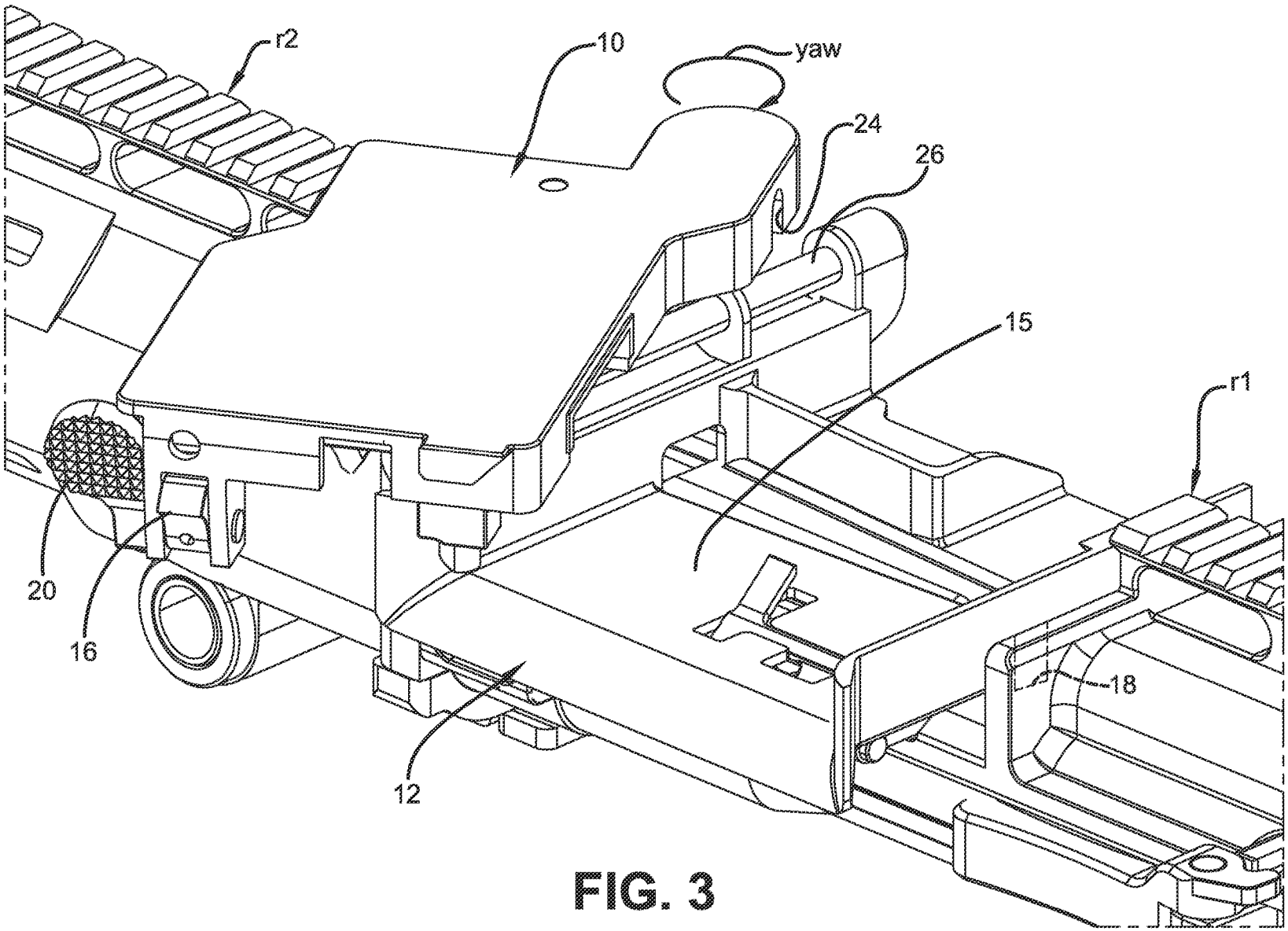
FIG. 3 is a perspective view of the embodiment of FIG. 1, showing the top cover pivoted in a yaw movement to provide access to a feed tray for loading cartridges.
Figure 4:
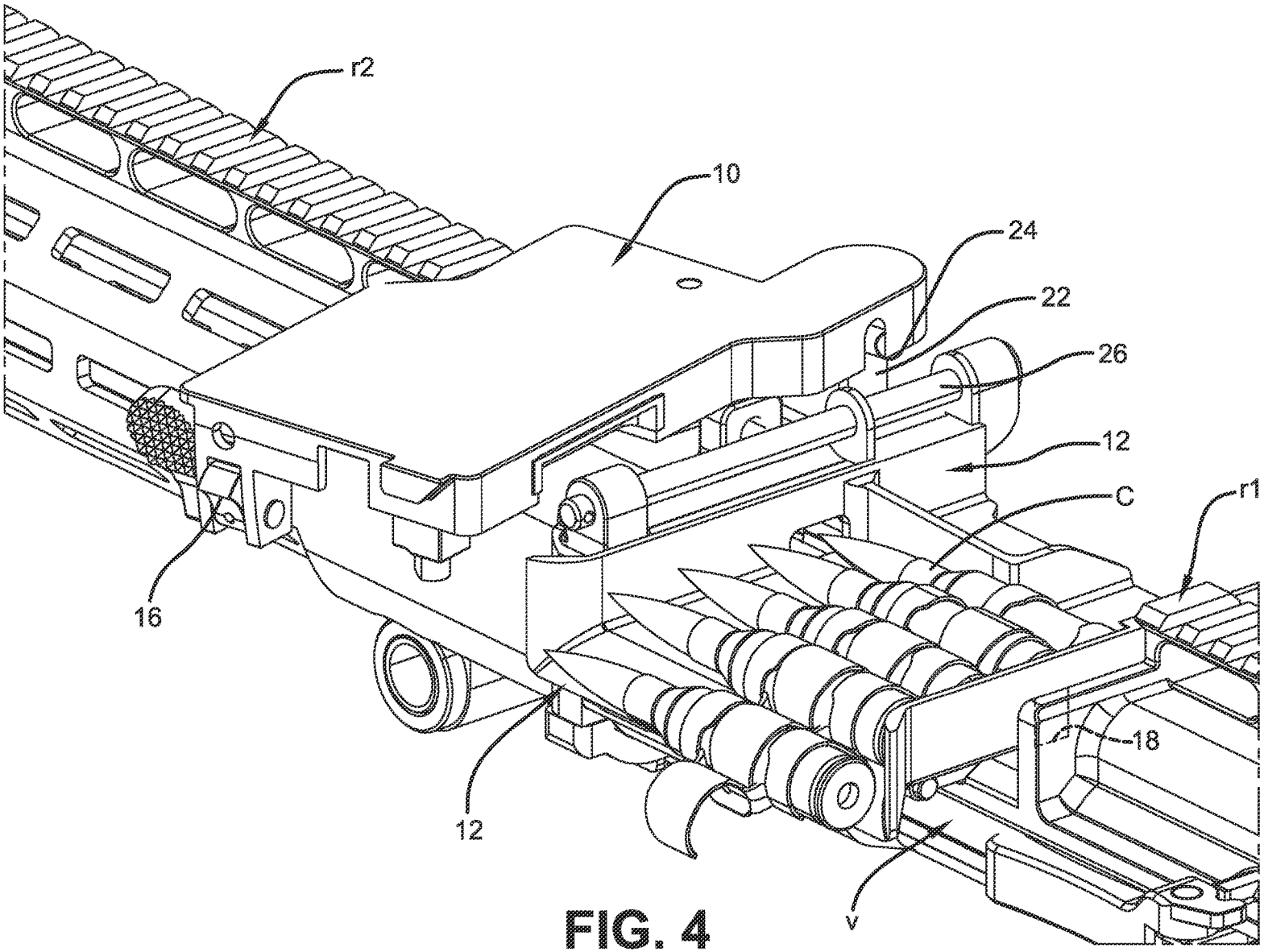
FIG. 4 is a perspective view, showing the top cover pivoted as in FIG. 3, and showing cartridges loaded to a feed tray.
Figure 9:
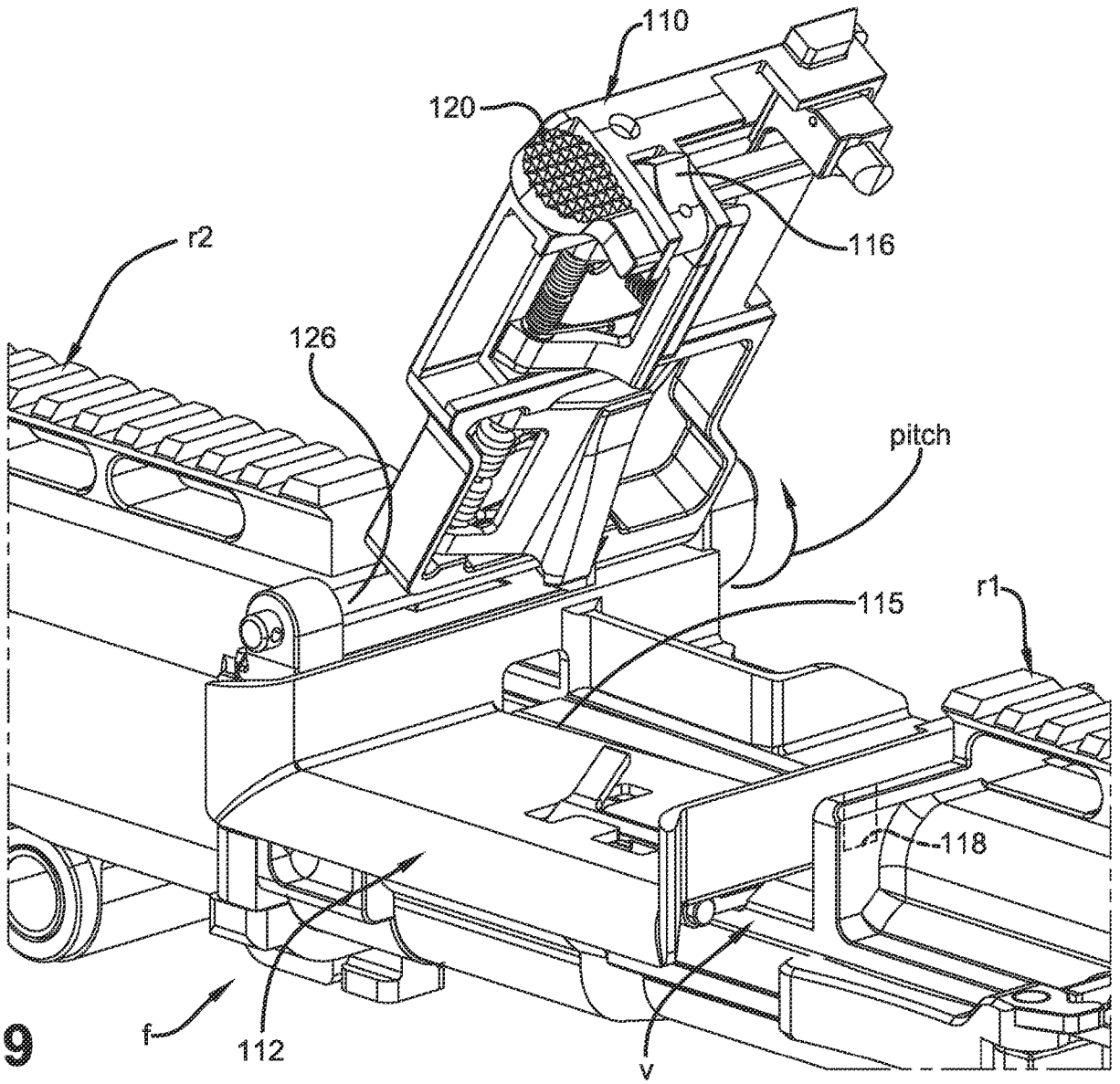
FIG. 9 is a perspective view of the embodiment of FIG. 8, showing the top cover pivoted upwardly in a pitch movement to open off of a feed tray from its normal position in line with the rails of the firearm (i.e., from its normal position for proper use and firing).
Figure 10:
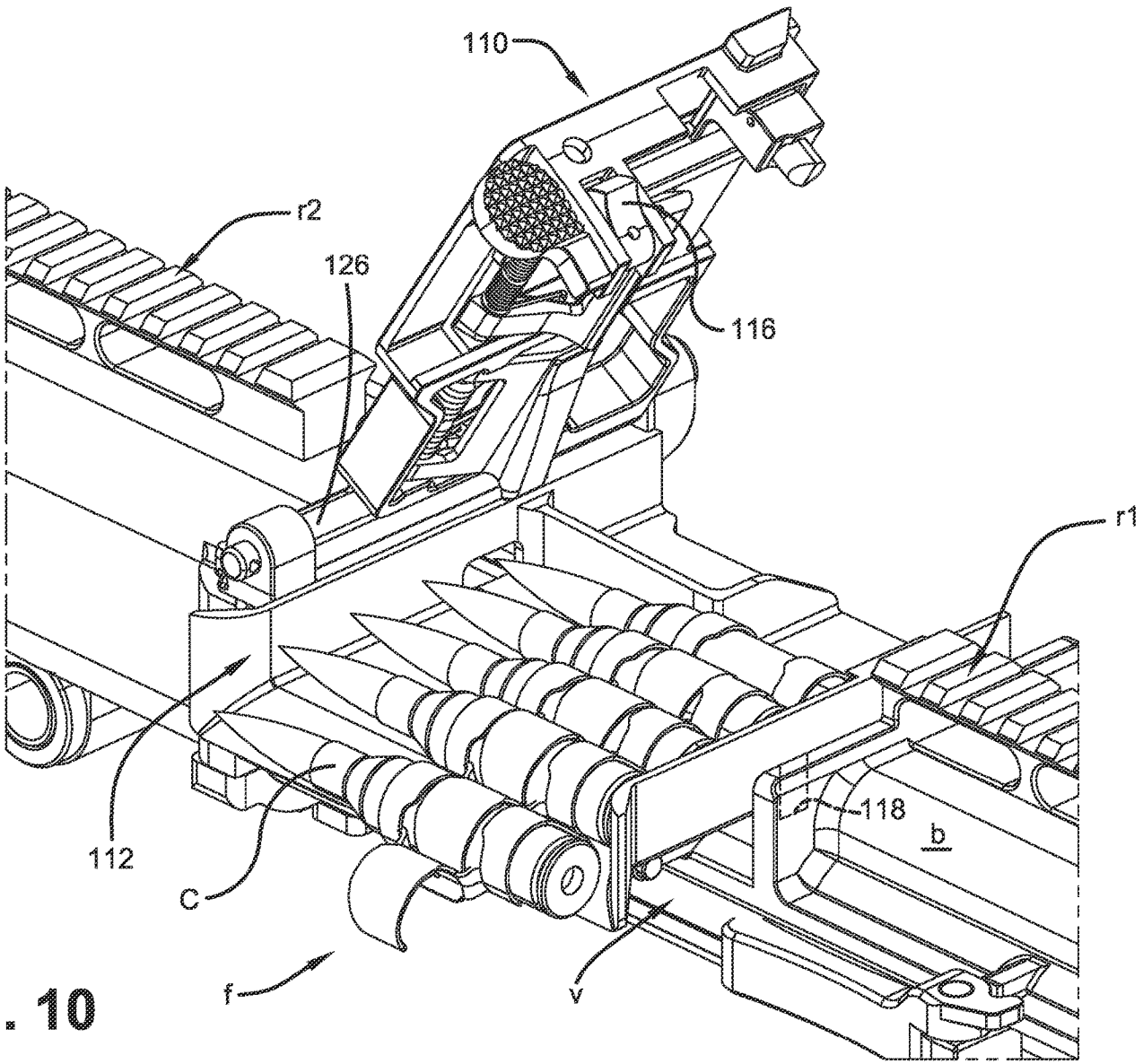
FIG. 10 is a perspective view showing the top cover as in FIG. 9, showing the loading of cartridges to the feed tray.

In FIG. 2, the top cover 10 is released from the firing position and is moved in a heave movement upwardly and off of the feed tray 12. In some embodiments, this movement disengages the top cover 10 from the feed tray 12, allowing for additional movement in a second degree of freedom. Particularly, once lifted off of the feed tray 12, top cover 10 can be moved in a yaw movement (about the z-axis) to provide access to the fed tray for the normal loading of cartridges c (FIG. 4). The reverse movement of the top cover 10 is used to reestablish the firing position. It is noted that the present invention is not limited to specific embodiments disclosed, and the invention relates to provide a top cover with multiple (at least two) degrees of freedom so as to permit the top cover to avoid optics or other peripheral accessories as it is opened up off of the feed tray. Of course, if there is no such optics or accessory obstruction, movement in more than one degree of freedom may not always be required for the loading and/or unloading of cartridges (e.g., see FIGS. 8-10), and the order of the translation and/or rotation operations might very well be different in other embodiments. Thus, in some embodiments, rotation in a roll movement about the x-axis might and/or a forward or backward surge movement would be possible in some embodiments.

Figure 5:
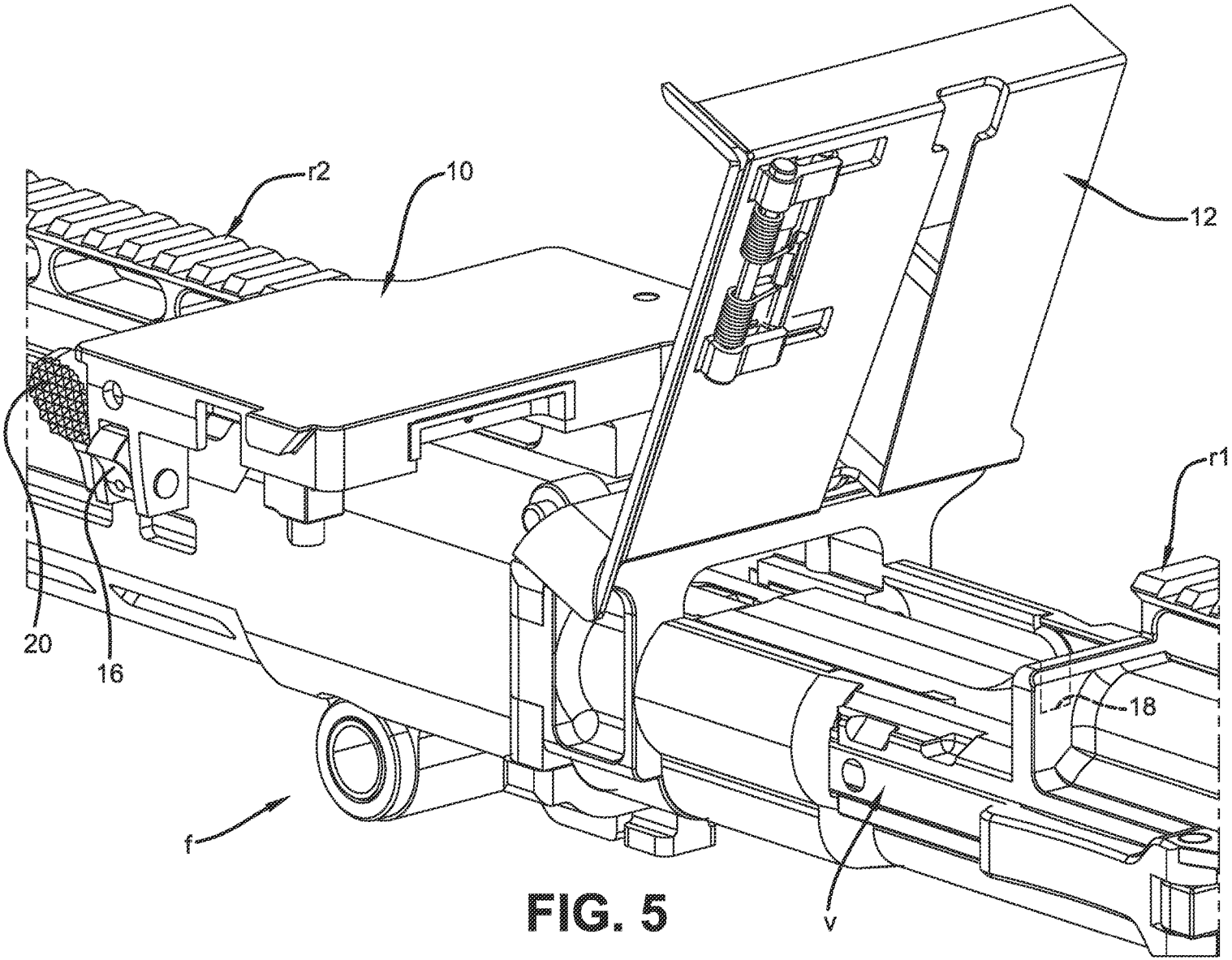
FIG. 5 is a perspective view, showing the top cover pivoted as in FIG. 3, and showing the feed tray with the ability to pivot upwardly in a pitch movement to open off the receiver.
Figure 6:
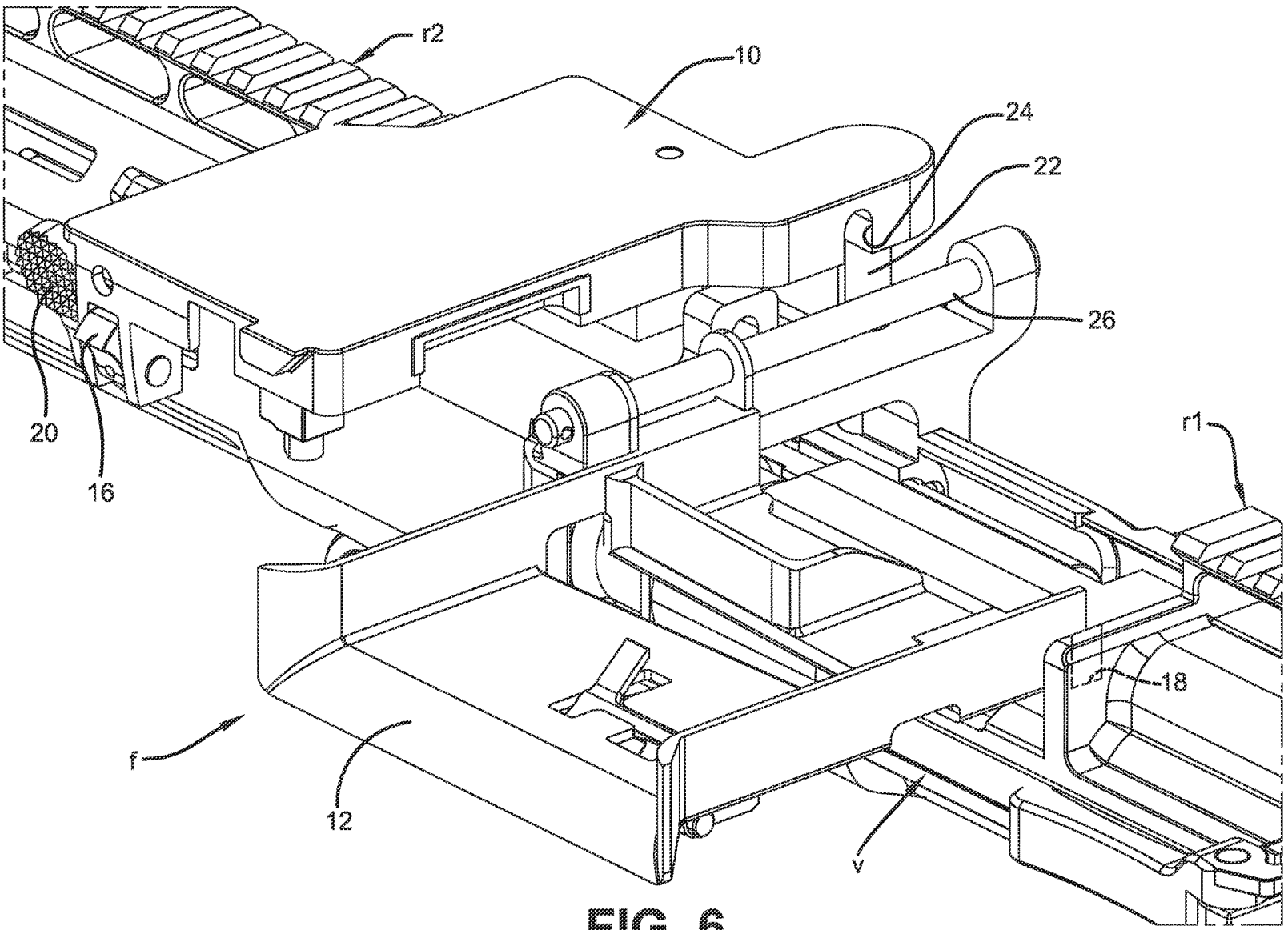
FIG. 6 is a perspective view, showing the top cover pivoted as in FIG. 3, and showing the feed tray with the ability to translate linearly out to the side of the firearm.
Figure 7:
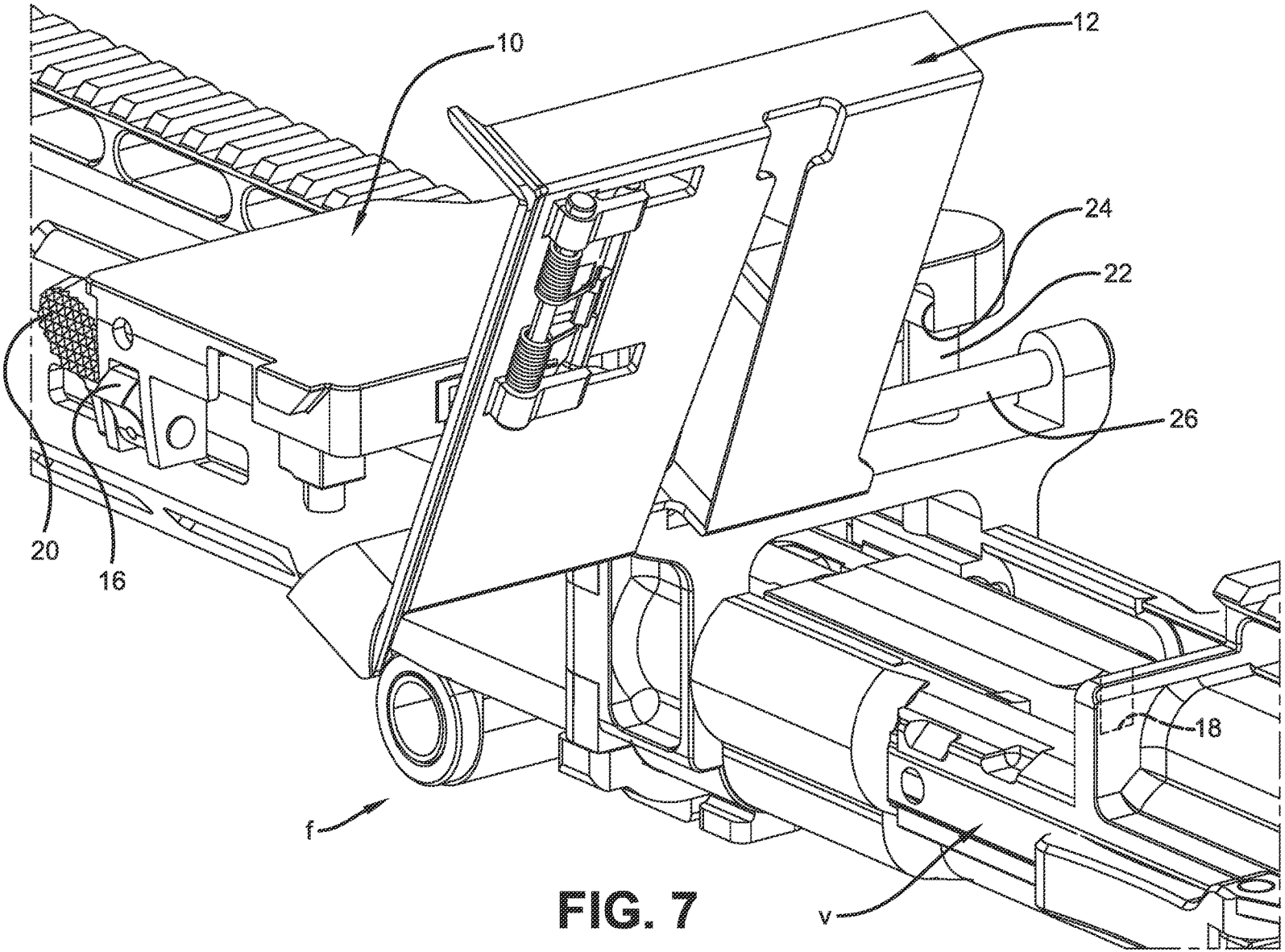
FIG. 7 is a perspective view, showing the top cover as in FIG. 6, but with the feed tray pivoted upwardly after being moved linearly out to the side.

In some embodiments, the top cover 10 is mounted to a post 22 on which the heave and yaw movements take place. In some embodiments, the top cover 10 is pivotally secured to the post 22 for said yaw movement and movable along said post 20 for said heave movement. In some embodiments, the top cover 10 is reinforced against yaw movement by a cross pin slot 24, fitting over a cross pin 26 for the top cover 10 and/or feed tray 12. The cross pin 26 also provides for proper alignment of the top cover with the feed tray when the cross pin 26 and cross pin slot 24 align and interact. In some embodiments, as seen in FIGS. 5-7, the feed tray 12 pivots on the cross pin 26 to allow it to open it off of the firearm's receiver and allow for cleaning or clearing of obstructions. As seen in FIG. 5, in some embodiments, the feed tray 12 can pivot or rotate upward (pitch movement) while in its firing position relative to the cross pin 26. In some embodiments, and as seen in FIGS. 6 and 7, the feed tray 12 can be moved along the cross pin 26 in a sway movement out to the side of the firearm, while also being able to pivot or rotate upward (pitch movement).

These general concepts can be applied to provide a firearm that is improved by having a top cover that is able to move in or with more than one degree of freedom. Particular degrees of freedom are exemplified in the embodiments just disclosed, and further, non-limiting embodiments, are next disclosed, showing other degrees of freedom for a top cover in accordance with other embodiments. Movement in more than one degree of freedom may not always be required for the loading and/or unloading of cartridges (for example, see FIG. 10), and the order of the translation and/or rotation operations might very well be different in other embodiments. It is sufficient to practice the present invention by providing a top cover that moves in at least two motions selected from surge, sway, heave, roll, pitch, and yaw.

Figure 14:
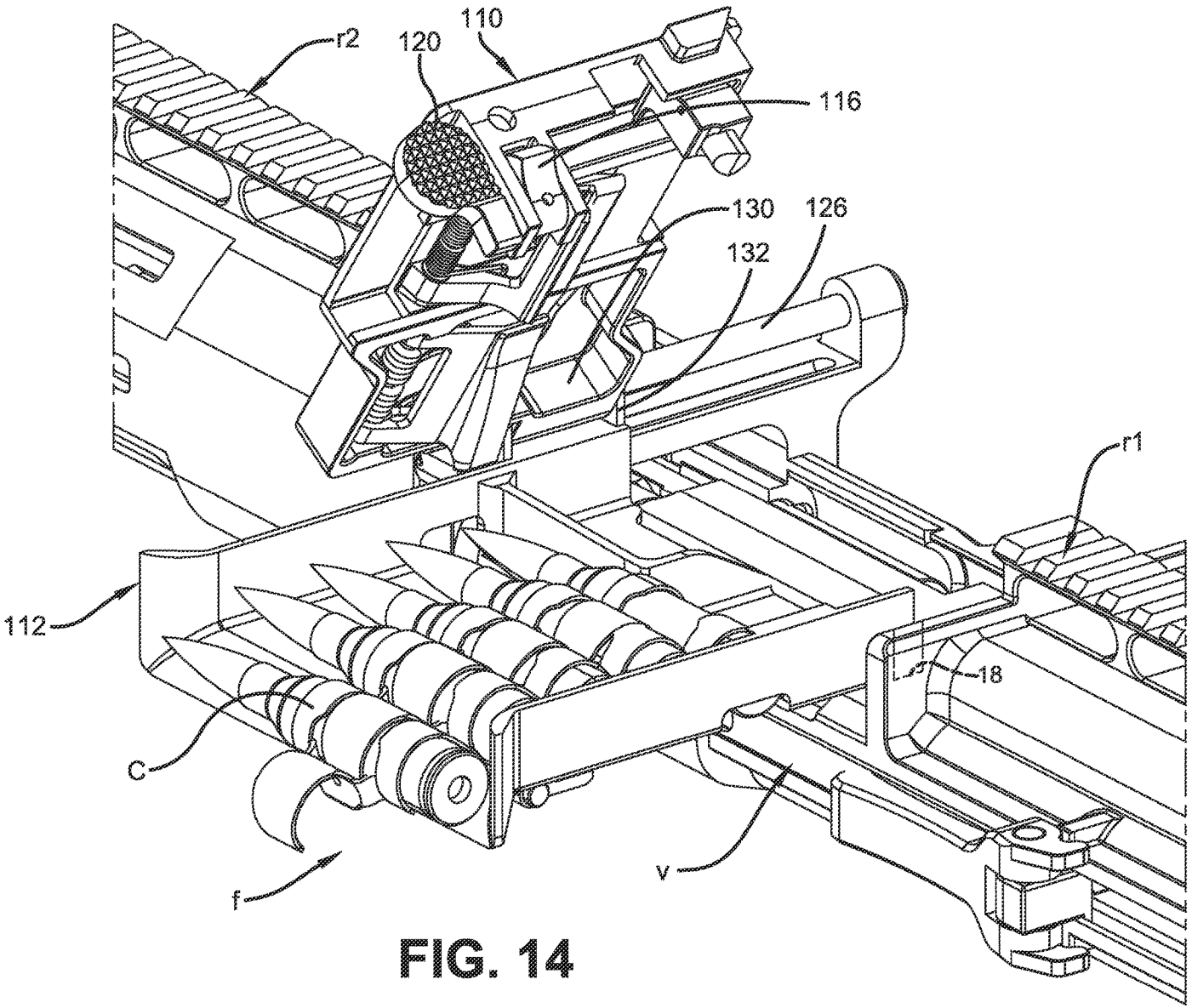
FIG. 14 is a perspective view as in FIG. 13, showing cartridges loaded to the feed tray.

Referring now to FIG. 8-15, the firearm f includes a receiver v having a top cover 110 that moves in two degrees of freedom, with a sway movement (from FIG. 8 to FIG. 12) moving both the top cover 110 and the feed tray 112 off to the side of the firearm, and a pitch movement (FIG. 13) pivoting the top cover 10 out from overtop of the feed tray 112 to provide access to a feed surface 115. In some embodiments, as shown in FIG. 14, cartridges c can be loaded onto the feed tray 112 in this position. The top cover 110 has a firing position (e.g., FIG. 8), where cartridges can be loaded and held between the top cover 110 and feed tray 112 and can be fired as commonly known. In some embodiments, the top cover 110 has a latching mechanism 114 serving to hold the top cover 110 in the firing position, and manipulatable to release the top cover 110 from the firing position and permit the movements described. In some embodiments, the latching mechanism 114 includes a latch 116 associated with the top cover 110 and a catch 118 associated with the remainder of the firearm f so as to interact and releasably hold the top cover 110 in the firing position (closed on the feed tray 112 and in position over the firearm's receiver). In other embodiments, the latch is associated with the firearm and the catch is part of the top cover, as the interaction of latches and catches is relative and reversible. In some embodiments, a push button 120 is associated with the latch 116 to move the latch 116 out of contact with catch 118 and permit the sway movement. In some embodiments, the push button 120 works against a spring load against the latch 116, the spring load urging the latch 116 to the position at which it interacts with and latches to the catch 118. In the particular embodiment shown, the catch 118 is provided in the firearm's upper receiver and holds the top cover to prevent the sway and pitch movements next disclosed. Although a single latch is shown, in this or other embodiments, there could be multiple latching mechanisms to prevent different movements or secure different parts together. Push buttons are just one mechanism found useful in the exemplary embodiments, and those of ordinary skill in the art will readily appreciate that other mechanisms could be used to catch and release parts.

In FIG. 12, the top cover 110 is released from the firing position (e.g. using the latching mechanism 114) and is moved in a sway movement along cross pin 126. In some embodiments, the feed tray 112 moves with the top cover 110, the top cover 110 and feed tray 112 forming a cassette that moves as a unit along the cross pin 126. In some cassette embodiments, the top cover 110 has an extension or top cover lug 130 that rides on the cross pin 126, and the top cover lug 130 is positioned between two feed tray alignment ears 132 on the feed tray 112 that mount the feed tray 112 to the cross pin 126. The top cover 110 can be rotated opened directly in a pitch movement (about the y-axis) from the closed position to allow cartridges c to be loaded onto the feed tray 112 (FIG. 10), or the top cover 110 and feed tray 112 cassette might first be moved off to the side in a sway movement, and then the top cover 110 rotated open in a pitch movement (about the y-axis) up off of the feed tray 112

(FIG. 13) to allow for the normal loading of cartridges c (FIG. 14). The reverse movement (pitch down, sway over) of the top cover 110 and feed tray 112 cassette could then be used to reestablish the firing position after loading of the cartridges c.

Figure 11:
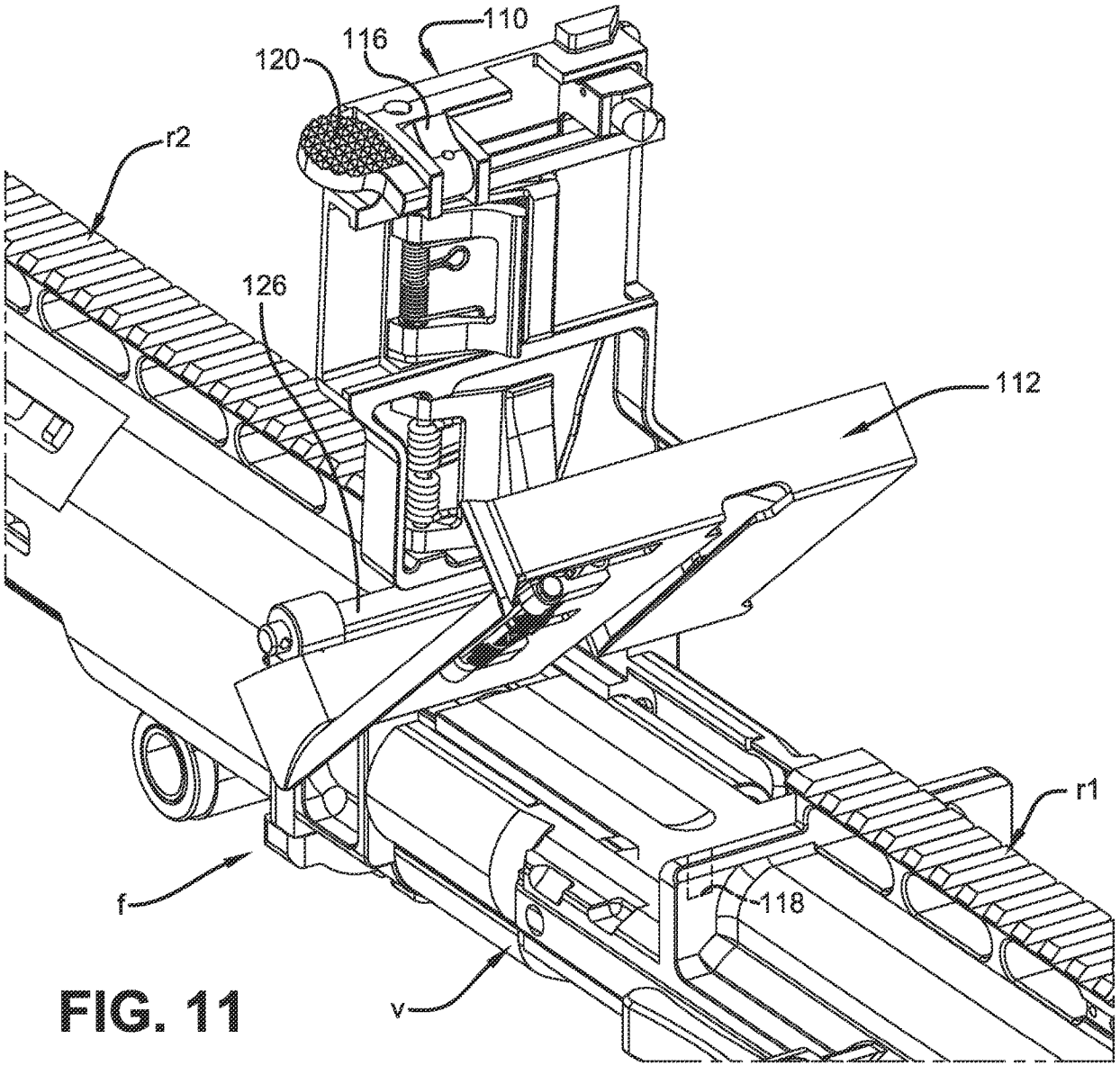
FIG. 11 is a perspective view showing the top cover as in FIG. 10, but with the feed tray pivoted upwardly in a pitch movement to open off the receiver.
Figure 15:
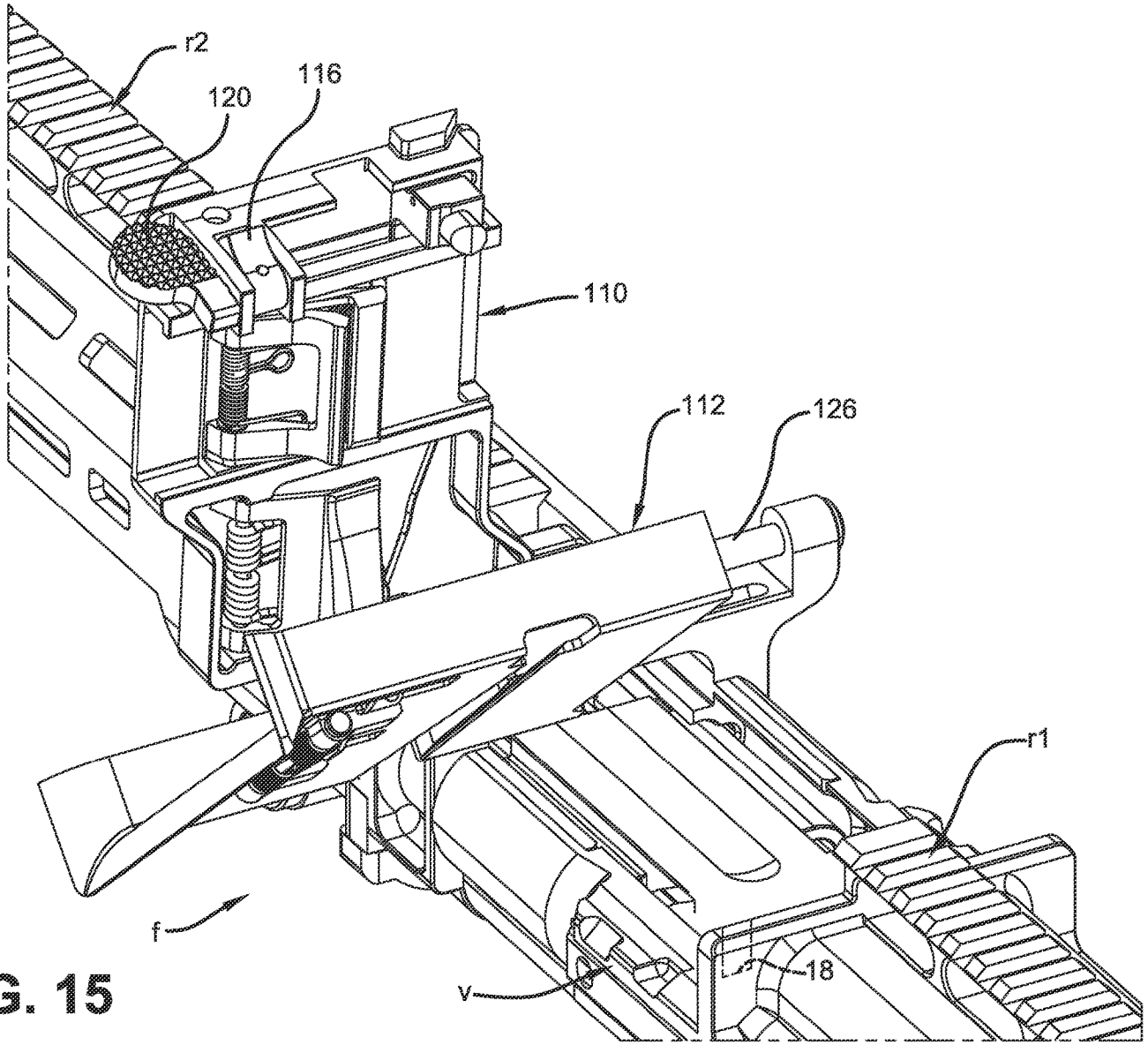
FIG. 15 is a perspective view as in FIG. 14, showing the feed tray pivoted upwardly in a pitch movement to open off the receiver.

In some embodiments, as seen in FIGS. 8-11, the top cover 110 can be pivoted in a pitch movement up off of the feed tray 112, directly from its firing position. This action would allow for reloading (see FIG. 10) in instances where there are no optics or other peripheral accessories extending over the top cover. As seen in FIG. 11, in some embodiments, once the top cover 110 has been rotated open, the feed tray 112 can pivot directly upward from its firing position on the cross pin 126 (pitch movement) to open it off of the firearm's receiver and allow for cleaning or clearing of obstructions. In some embodiments, and as seen in FIG. 15, the feed tray 112 can be moved along the cross pin 26 in a sway movement out to the side of the firearm, while also being able to pivot upward (pitch movement).

It will be appreciated that the present invention is fully disclosed for implementation in any number of firearms. A particular firearm, with a particular top cover and feed tray, is shown, with particular latches, catches, feed levers, pawls and the like, as generally known to those of ordinary skill in the art, and the structure and functioning and alternative choices for (or omission of) any such feature need not be belabored.

In light of the foregoing, it should be appreciated that the present invention significantly advances the art by providing a belt-fed firearm top cover that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

ELEMENT LIST FOR FIGURES f Firearm
r1, r2 Rails
v Receiver
c Cartridges
10 Top Cover
12 Feed Tray
14 Latching Mechanism
15 Feed Surface
16 Latch
18 Catch
20 Button
22 Post
24 Cross Pin Slot
26 Cross Pin
110 Top Cover
112 Feed Tray
115 Feed Surface
114 Latching Mechanism
116 Latch
118 Catch
120 Button
122 Post
124 Cross Pin Slot
126 Cross Pin
130 Top Cover Lug
132 Feed Tray Alignment Ear

What is claimed is:

1. In a belt-fed firearm having a top cover manipulatable to provide access to a feed surface for cartridges, the improvement comprising the top cover moving in at least two degrees of freedom.

2. The improvement of claim 1, wherein and the at least two degrees of freedom together allow movement of the top cover to both clear a peripheral accessory mounted to the firearm and open access to the feed surface to permit loading of cartridges to the feed surface.

3. The improvement of claim 2, wherein the at least two degrees of freedom are selected from surge, sway, heave, roll, pitch, and yaw.

4. The improvement of claim 3, wherein a first degree of freedom of the at least two degrees of freedom permits movement of the top cover in such a way as to separate the top cover from the feed surface.

5. The improvement of claim 4, wherein a second degree of freedom of the at least two degrees of freedom permits movement of the top cover to a side of the firearm, so that the top cover is configured to move out from under a peripheral accessory, if any, on the firearm.

6. The improvement of claim 5, wherein the first degree of freedom is a heave movement along a z-axis in the direction of from the underside of the firearm to a topside of the firearm.

7. The improvement of claim 6, wherein the second degree of freedom is a yaw movement relative to an x-axis in the direction of from the back of the firearm to the front of the firearm and rotating about the z-axis.

8. The improvement of claim 7, wherein the yaw movement opens access to the feed surface to permit loading of cartridges to the feed surface.

9. The improvement of claim 7, further comprising a post extending along the z-axis, the top cover pivotally secured to the post for said yaw movement and movable along said post for said heave movement.

10. The improvement of claim 2, wherein a first degree of freedom is a sway movement relative to a y-axis in the direction of from the right side of the firearm to the left side of the firearm.

11. The improvement of claim 10, wherein a second degree of freedom of the at least two degrees of freedom opens access to the feed surface to permit loading of cartridges to the feed surface.

12. The improvement of claim 10, wherein the second degree of freedom is a pitch movement rotating about the y-axis.

13. The improvement of claim 12, further comprising a rail extending along the y-axis, the top cover pivotally secured to the post for said pitch movement and movable along said rail for said sway movement.

14. The improvement of claim 13, wherein the feed surface is provided by a feed tray, and the feed tray moves with the top cover through said sway movement along the rail in the first degree of freedom, and thereafter the top cover moves through said pitch movement to provide access to the feed tray.

15. The improvement of claim 14, wherein the top cover and the feed tray engage in a closed position and are released from engagement to allow for said pitch movement of the top cover.

16. The improvement of claim 15, wherein cartridges can be properly loaded to the feed tray after said sway movement and pitch movement of the top cover.

17. The improvement of claim 16, wherein the feed tray is also movable through said pitch movement to provide access to internal components or areas of the firearm.

18. A belt-fed firearm comprising:

a top cover, wherein the top cover can move in at least two degrees of freedom of motion selected from surge, sway, heave, roll, pitch, and yaw, and wherein the movement in at least two degrees of freedom allows movement of the top cover to clear a peripheral accessory mounted to the firearm and allows open access to a feed surface of the firearm to permit loading of cartridges to the feed surface.

19. The firearm of claim 18, wherein a first degree of freedom of the at least two degrees of freedom allows the top cover to separate from the feed surface.

20. The firearm of claim 19, wherein a second degree of freedom of the at least two degrees of freedom permits movement of the top cover to a side of the firearm, so that the top cover is configured to move out from under a peripheral accessory, if any, on the firearm.

* * * * *